US009307842B2

(12) United States Patent
Gibbons

(10) Patent No.: US 9,307,842 B2
(45) Date of Patent: Apr. 12, 2016

(54) MULTI-PILLOW BODY SUPPORT SYSTEMS AND METHODS

(71) Applicant: The Boppy Company, LLC, Golden, CO (US)

(72) Inventor: Haley Gibbons, Wheat Ridge, CO (US)

(73) Assignee: THE BOPPY COMPANY, LLC, Golden, CO (US)

( * ) Notice: Subject to any disclaimer, the term of this patent is extended or adjusted under 35 U.S.C. 154(b) by 20 days.

(21) Appl. No.: 14/525,389

(22) Filed: Oct. 28, 2014

(65) Prior Publication Data

US 2015/0040320 A1 Feb. 12, 2015

Related U.S. Application Data

(63) Continuation-in-part of application No. 14/491,033, filed on Sep. 19, 2014, which is a continuation of application No. 13/757,508, filed on Feb. 1, 2013, now Pat. No. 8,863,334.

(51) Int. Cl.

| | |
|---|---|
| ***A47C 20/02*** | (2006.01) |
| ***A47G 9/00*** | (2006.01) |
| ***A47G 9/10*** | (2006.01) |
| ***A47C 20/00*** | (2006.01) |

(52) U.S. Cl.

CPC ..... *A47C 20/025* (2013.01); *A47C 20/021* (2013.01); *A47C 20/023* (2013.01); *A47C 20/027* (2013.01); *A47G 9/10* (2013.01)

(58) Field of Classification Search

CPC ..... A47G 9/10; A47G 9/1045; A47G 9/109; A47G 9/0253; A47G 9/00; A47C 20/025; A47C 20/02; A47C 21/026

USPC ..... 5/630, 631, 632, 640, 645, 652

See application file for complete search history.

(56) References Cited

U.S. PATENT DOCUMENTS

| | | | | |
|---|---|---|---|---|
| 682,871 | A | 9/1901 | Hogan et al. | |
| 1,343,357 | A | 6/1920 | Eggers | |
| 2,328,871 | A | 9/1943 | Woehler | |
| 2,961,668 | A | 11/1960 | Hayes | |
| 3,667,074 | A | 6/1972 | Emery | |
| 3,842,977 | A | 10/1974 | Hollander | |
| 3,848,281 | A | 11/1974 | Mathews | |
| 3,849,810 | A * | 11/1974 | Degen | 5/640 |

(Continued)

FOREIGN PATENT DOCUMENTS

| | | | |
|---|---|---|---|
| DE | 4205650 | A1 | 11/1993 |
| EP | 1306034 | A1 | 5/2003 |

(Continued)

OTHER PUBLICATIONS

Non-Final Office Action mailed Sep. 11, 2015 in U.S. Appl. No. 14/491,033, filed Sep. 19, 2014, 11 pages.

(Continued)

*Primary Examiner* — David E Sosnowski
*Assistant Examiner* — Ifeolu Adeboyejo
(74) *Attorney, Agent, or Firm* — Kilpatrick Townsend & Stockton LLP

(57) ABSTRACT

A pillow system includes a slipcover, a pillow body, and a torso pillow. The slipcover is disposed about the pillow body. The slipcover has a pocket for holding the torso pillow. The torso pillow can be removed from the pocket and the pocket stowed within the slipcover.

12 Claims, 14 Drawing Sheets

(56) References Cited

U.S. PATENT DOCUMENTS 3,920,239 A 11/1975 White
4,161,794 A 7/1979 Darnfors
4,197,604 A 4/1980 Nakamura
D255,966 S 7/1980 Stadel
4,227,270 A 10/1980 Rivera
4,236,264 A 12/1980 Britzman
4,345,347 A 8/1982 Kantor
4,434,513 A 3/1984 Welch
4,523,588 A * 6/1985 Dolsky ..... A62B 17/04 128/201.25
4,617,691 A * 10/1986 Monti et al. ..... 5/640
4,624,021 A 11/1986 Hofstetter
4,731,890 A 3/1988 Roberts
4,754,510 A 7/1988 King
4,858,259 A 8/1989 Simmons et al.
4,901,384 A 2/1990 Eary
D315,845 S 4/1991 Lafley
5,029,350 A 7/1991 Edelson
D318,969 S 8/1991 Byrn
5,056,533 A 10/1991 Solano
5,097,551 A 3/1992 Smith
5,115,528 A * 5/1992 Lamle ..... 5/640
5,134,740 A 8/1992 Summer
5,138,728 A * 8/1992 Aston ..... 5/645
5,154,649 A 10/1992 Pender
5,193,235 A 3/1993 Kircher
5,257,429 A 11/1993 Genis
5,261,134 A 11/1993 Mathews
5,269,323 A 12/1993 Krouskop
5,297,304 A 3/1994 O'Sullivan
5,313,678 A * 5/1994 Redewill ..... A47C 21/003 297/393
D348,174 S 6/1994 Genis
D352,633 S 11/1994 Berggren
D360,554 S 7/1995 Righini
5,499,418 A * 3/1996 Tan ..... A47D 15/008 5/655
5,515,563 A 5/1996 Chao
5,519,906 A 5/1996 Fanto-Chan
5,546,620 A 8/1996 Mathews
5,581,833 A 12/1996 Zenoff
D377,881 S 2/1997 Watt
5,661,861 A 9/1997 Mathews
5,664,271 A * 9/1997 Bellavance ..... 5/632
5,702,153 A 12/1997 Pliska
D393,772 S 4/1998 Vingino
D395,782 S 7/1998 Weddle
5,790,999 A 8/1998 Clark
D416,159 S 11/1999 Porter
5,978,990 A 11/1999 Akey
5,979,981 A 11/1999 Dunne et al.
5,987,674 A 11/1999 Schaffner et al.
6,038,720 A 3/2000 Mathews et al.
6,052,848 A 4/2000 Kelly
6,055,687 A 5/2000 Mathews
6,182,311 B1 2/2001 Buchanan
6,202,232 B1 3/2001 Andrei
6,233,767 B1 5/2001 Horowitz
6,279,185 B1 8/2001 Mathews
6,321,403 B1 11/2001 Mathews
6,349,437 B1 2/2002 Horning
6,354,665 B1 3/2002 Ross
6,394,554 B1 5/2002 Hingle
6,412,128 B1 7/2002 Mathews
6,434,770 B2 8/2002 Mathews Brown
6,453,493 B1 9/2002 Mathews Brown
6,463,608 B1 10/2002 Moe
6,484,337 B1 * 11/2002 Moe et al. ..... 5/652
6,487,737 B1 12/2002 Futagami
6,499,164 B1 12/2002 Leach
6,523,200 B2 2/2003 Brown
6,532,612 B2 3/2003 Mathews Brown
6,553,590 B1 4/2003 Leach
6,564,408 B2 5/2003 Van Vuuren
6,625,828 B2 9/2003 Matthews Brown
6,640,977 B2 11/2003 Matthews Brown et al.
6,651,282 B1 11/2003 Skoug et al.
6,658,681 B2 12/2003 Britto et al.
6,668,400 B1 * 12/2003 Nichols et al. ..... 5/485
6,668,404 B2 12/2003 Lanteri
6,671,908 B2 1/2004 Brown et al.
6,685,024 B1 2/2004 Matthews
6,691,352 B2 * 2/2004 Wang ..... 5/636
6,708,354 B1 3/2004 Carter
6,711,770 B1 3/2004 Owens et al.
6,751,817 B1 6/2004 Leach
6,760,934 B1 7/2004 Leach
6,763,539 B1 7/2004 Bartley et al.
6,795,990 B1 * 9/2004 Hutchinson ..... 5/632
6,842,925 B1 1/2005 Owens et al.
6,857,150 B2 2/2005 Matthews Brown et al.
D503,062 S 3/2005 Nash
6,874,183 B1 4/2005 Taylor
6,886,201 B1 5/2005 Weiss-Lohrei
6,944,898 B2 9/2005 Matthews Brown et al.
7,000,275 B2 2/2006 Matthews Brown et al.
7,017,212 B2 3/2006 Matthews Brown
7,055,196 B2 6/2006 Littlehorn
7,089,614 B1 8/2006 Clapp
7,089,617 B1 * 8/2006 Lauro ..... A47G 9/10 5/490
7,089,639 B2 8/2006 Matthews Brown et al.
D527,937 S 9/2006 Aiken et al.
7,114,206 B2 10/2006 Leach
7,127,760 B2 10/2006 Bartley et al.
D547,586 S 7/2007 Weiss-Lohrei
7,290,303 B2 11/2007 Mead et al.
7,353,552 B2 4/2008 Leach
7,451,508 B2 11/2008 Matthews Brown et al.
7,472,443 B2 1/2009 Littlehorn et al.
7,513,001 B1 * 4/2009 Leach ..... 5/655
7,540,050 B1 6/2009 Nazer
7,562,406 B1 * 7/2009 Leach ..... 5/655
7,587,773 B2 * 9/2009 Littlehorn ..... A47C 16/00 5/632
7,624,461 B2 12/2009 Tidwell et al.
7,793,371 B1 * 9/2010 Leach ..... 5/632
7,801,191 B2 9/2010 Bessho
7,810,191 B2 10/2010 Littlehorn et al.
7,886,381 B2 2/2011 Aiken et al.
8,074,310 B1 12/2011 Robbins
8,136,186 B1 * 3/2012 Leach ..... A47C 20/025 5/631
8,321,978 B1 * 12/2012 Fulton ..... A47G 9/1045 5/636
8,448,275 B1 * 5/2013 Leach ..... A47C 20/027 297/284.5
8,495,775 B2 7/2013 Fair et al.
8,516,638 B2 8/2013 Kummerfeld et al.
D699,981 S 2/2014 Kummerfeld et al.
D699,982 S 2/2014 Fair et al.
D704,963 S 5/2014 McNeil et al.
8,763,183 B2 7/2014 Tidwell
D713,171 S 9/2014 Fair et al.
8,863,334 B2 10/2014 Gibbons et al.
8,893,334 B1 * 11/2014 Wong ..... 5/640
8,950,029 B2 2/2015 Tidwell
9,021,635 B1 5/2015 Leach
9,113,719 B2 8/2015 Kummerfeld et al.
2002/0014436 A1 2/2002 Matthews Brown
2002/0050007 A1 * 5/2002 Kim ..... A47G 9/10 5/636
2004/0060116 A1 4/2004 Matthews Brown
2004/0154104 A1 8/2004 Matthews Brown et al.
2004/0226096 A1 11/2004 Davis
2005/0000023 A1 1/2005 Matthews Brown et al.
2005/0005359 A1 1/2005 Matthews Brown
2005/0015883 A1 1/2005 Bartley et al.
2005/0060806 A1 * 3/2005 Wilkinson ..... 5/632
2005/0125902 A1 6/2005 Matthews Brown et al.
2005/0210591 A1 9/2005 Mead et al.
2005/0229316 A1 * 10/2005 Liao ..... A47G 9/1045 5/639
2005/0278864 A1 * 12/2005 Leach ..... 5/732

(56) References Cited

U.S. PATENT DOCUMENTS

| | | | | |
|---|---|---|---|---|
| 2006/0021146 | A1 | 2/2006 | Tokarz | |
| 2006/0042012 | A1 | 3/2006 | Littlehorn | |
| 2007/0067914 | A1* | 3/2007 | Littlehorn | A47C 16/02 5/632 |
| 2007/0151031 | A1* | 7/2007 | Leach | 5/632 |
| 2007/0192961 | A1 | 8/2007 | Tidwell et al. | |
| 2007/0271703 | A1 | 11/2007 | Matthews Brown et al. | |
| 2008/0052832 | A1 | 3/2008 | Racovolis | |
| 2008/0148487 | A1 | 6/2008 | Lord | |
| 2008/0222813 | A1 | 9/2008 | Aikman | |
| 2009/0094749 | A1 | 4/2009 | Littlehorn et al. | |
| 2009/0235459 | A1* | 9/2009 | Tidwell et al. | 5/640 |
| 2009/0313760 | A1 | 12/2009 | Blake | |
| 2010/0175192 | A1 | 7/2010 | Aiken | |
| 2010/0281617 | A1 | 11/2010 | Brun | |
| 2011/0154572 | A1 | 6/2011 | Fair et al. | |
| 2012/0110742 | A1 | 5/2012 | Lawler | |
| 2012/0240339 | A1 | 9/2012 | Fair et al. | |
| 2012/0278994 | A1 | 11/2012 | Bonzer et al. | |
| 2012/0304387 | A1 | 12/2012 | Crompton | |
| 2013/0125314 | A1 | 5/2013 | Kummerfeld et al. | |
| 2013/0145556 | A1 | 6/2013 | Kummerfeld et al. | |
| 2013/0198962 | A1* | 8/2013 | Melcher et al. | 5/652 |
| 2013/0340173 | A1 | 12/2013 | Tidwell | |
| 2014/0215719 | A1 | 8/2014 | Gibbons et al. | |
| 2015/0013069 | A1 | 1/2015 | Tidwell | |
| 2015/0067966 | A1 | 3/2015 | Gibbons et al. | |

FOREIGN PATENT DOCUMENTS

| | | | |
|---|---|---|---|
| FR | 1430355 | | 3/1966 |
| FR | 2379268 | | 9/1978 |
| GB | 215848 | | 5/1924 |
| GB | 1508809 | | 4/1978 |
| GB | 2198341 | A | 6/1988 |
| GB | 2205236 | A | 12/1988 |
| WO | WO 02/21978 | A2 | 3/2002 |
| WO | WO 02/21979 | A1 | 3/2002 |
| WO | WO 02/28232 | A1 | 4/2002 |

OTHER PUBLICATIONS

U.S. Appl. No. 10/927,404, filed Aug. 2004, Littlehorn.

U.S. Appl. No. 11/169,600, filed Jun. 2005, Littlehorn et al.

Leachco Adjustable Nursing Pillow, http://store.yahoo.com/leachco/naturalboost.html, May 16, 2005, 2pgs.

Leachco, Positional Nursing Pillow, http://store.yahoo.com/leachco/13560.html, May 16, 2005, 1pg.

Leachco Infant Support Cushion, http://store.yahoo.com/leachco/lecuddler.html, Apr. 20, 2005, 2pgs.

Baby Supercenter, Deluxe Nurse 'N Play Pillow, http://www.babysupercenter.com/cgi-bin/webc.cgi/st_prod.html?p_prodid=13407&p_catid=&sid=5dy8u., Apr. 20, 2005, 1 pg.

Parents of Invention, Nurse n' Sleep, http://www.parentsofinvention.com/products/NurseSleep.htm., Apr. 20, 2005, 1pg.

Simplicity for Children, Hugger with Vibration, http://www.simplicityforchildren.com/ourproducts/nursingpillows/9300PGH.htm, Apr. 20, 2005, 3 pgs.

Touch for Life, Regular Hugster, http://www.touchforlife.biz/products/family/hugster.html, Apr. 20, 2005, 4 pgs.

Luvee Baby Products, The Luvee Nursing Pillow, http://www.theluvee.com/, Apr. 20, 2005, 1 pg.

Luvee Baby Products, Nursing Pillow, http://www.theluvee.com/benefits.htm, Apr. 20, 2005, 1 Pg.

My Brest Friend, Nursing Pillow, http://www.mybrestfriend.com/features.html, Apr. 20, 2005, 1 pg.

Peaceful Pea, The Nursing Nest, http://www.peacefulpea.com/nursing_nest.html, Apr. 20, 2005, 3 pgs.

Pregnancy Store, Kozy Kushion Nursing Pillow, http://www.pregnancystore.com/kozy_kushion.htm, May 16, 2005, 6 pgs.

Hammacher Schlemmer, Total Body Support Pillow, http://www.hammacher.com/publish/62341.asp?promo=search, Nov. 26, 2008, 1 pg.

Moonlight Slumber, The three-in-one body pillow from Moonlight Slumber, The serenity Star, www.moonlightslumber.com, Nov. 26, 2008, 1 pg.

Snoozer Body Pillows for adults, www.snoozer.com/whySnoozer.asp, Jul. 7, 2005, 7 pgs.

Sears, Body Pillow, item #09650132000, Mfr. Model #50132, Jul. 7, 2005, 1 pg.

Real Goods, Sleeping Bean Body Pillow, www.realgoods.com/shop/shop2.cfm/dp/205/ts/1008493, Jul. 7, 2005, 2 pgs.

The Comfort Store, The Original Sleeping Bean Body Pillows, www.sitincomfort.com/orslbebopi.html, Jul. 7, 2005, 3 pgs.

* cited by examiner

MULTI-PILLOW BODY SUPPORT SYSTEMS AND METHODS

CROSS-REFERENCES TO RELATED APPLICATIONS

This application is a continuation-in-part to co-pending U.S. application Ser. No. 14/491,033, filed on Sep. 19, 2014, which is a continuation of U.S. application Ser. No. 13/757,508, filed on Feb. 1, 2013, each of which is incorporated by reference in its entirety for all purposes.

BACKGROUND OF THE INVENTION

This invention relates generally to the field of pillows and, in particular, to pillows that may be used to support various parts of the body.

Pillows exist in a variety of shapes and sizes. Perhaps the most common type of pillow is generally rectangular and is filled with natural or synthetic materials. Such pillows are traditionally designed to support a person's head while lying in bed.

Another type of pillow is generally curved and has an interior well region. Such pillows have found use in supporting babies, when nursing, when sitting among others. Such pillows are described in U.S. Pat. Nos. 5,261,134, 5,661,861, 6,038,720, 6,055,687, 6,685,024, 6,434,770, 6,671,908, 6,532,612, 6,279,185, and 6,412,128, the complete disclosures of which are herein incorporated by reference.

A further type of pillow is a body support pillow that supports multiple parts of the body. An example of such a pillow is described in U.S. Pat. No. 7,810,191, the complete disclosure of which is herein incorporated by reference.

BRIEF SUMMARY OF THE INVENTION

This invention provides a variety of pillow systems and methods for their assembly and use. In some embodiments, a pillow system comprises a pillow body and a pocket that may be used to hold another, separate pillow. The pillow body comprises fill material and a fabric shell surrounding the fill material. The pillow body includes a head portion that is configured to support a user's head; a leg portion that is configured to support a user's leg; and a central portion disposed between the head portion and the leg portion. The pillow body is elongated and curved, having an outer periphery and an inner periphery that faces the user. The pocket is operably connected with the central portion so as to be extendable from the inner periphery, wherein the pocket is configured to hold a torso pillow. In some embodiments, the pocket is operably connected to the central portion pillow body by being part of a slipcover that is disposed around the pillow body. In some embodiments, the pocket is operably connected to the central portion of the pillow body by being connected to the fabric shell. In some embodiments, the pocket comprises a neck portion that forms an opening of the pocket through which the torso pillow is inserted into the pocket. The neck portion of the pocket has a first length; the torso pillow has a second length; and the second length is greater than the first length. In some embodiments, the central portion has a width that is more narrow than both a width of the head portion and a width of the leg portion. In some embodiments, the central portion comprises an opening, and the pocket is coupled to the opening. In some embodiments, the pocket encapsulates the torso pillow such that none of the torso pillow is observable to a user when the torso pillow is in the pocket. In some embodiments, the head portion has a first height (e.g., thickness); the leg portion has a second height; the central portion has a third height; and the first height and the second width are each greater than the third height.

In some embodiments, a slipcover for a pillow system is provided. The slipcover comprises a head section, a leg section, a central section, and a pocket. The central section is disposed between the head section and the leg section. The head section, the leg section, and the central section are configured to encapsulate a pillow body. The pocket is configured to hold a torso pillow, wherein the torso pillow is not the same as the first pillow.

In some embodiments, a method of using a pillow system is presented. A pillow body, a slipcover, and a torso pillow are provided. The pillow body is inserted into the slipcover. The torso pillow is inserted through an opening of an outer periphery of the slipcover and into the pocket of the slipcover. In some embodiments, the torso pillow is inserted through a second opening of the slipcover, wherein the second opening of the slipcover is on the inner periphery of the slipcover. In some embodiments, the pillow body comprises a head portion configured to support a the user's head and a leg portion configured to support the user's leg. In some embodiments, the method further comprises the user lying on the pillow system, with the user's head on the head portion, the user's leg on the leg portion, and the torso pillow supporting the user's abdomen.

DETAILED DESCRIPTION OF THE INVENTION

Embodiments disclosed generally relate to body pillows and methods of use. In a first embodiment, a multi-pillow support system comprises a body pillow, a torso pillow, and a slipcover. The body pillow is an elongated, curved pillow (roughly "c"-shaped) having a head portion, a central portion, and a leg portion. The slipcover has a main chamber that encases the body pillow and has a pocket to hold the torso pillow. The torso pillow can be inserted into, and removed from, the pocket. The multi-pillow support system can be used by most anyone, but, in some embodiments, is more particularly designed for a woman who is pregnant. For example, a woman who is pregnant rests her head on the head portion, a leg on the leg portion, and abdomen (e.g., enlarged due to pregnancy) on the torso pillow. The pocket can be stowed in the main chamber when not in use. The slipcover is configured to be removed from the body pillow (e.g., for washing and/or for changing colors/style of the multi-pillow support system). In a second embodiment, the pocket is attached to the body pillow instead of the slipcover. The pocket can be stowed in a cavity in the body pillow when not used. Additional embodiments, configurations, and uses will be apparent from this disclosure.

Figure 1:
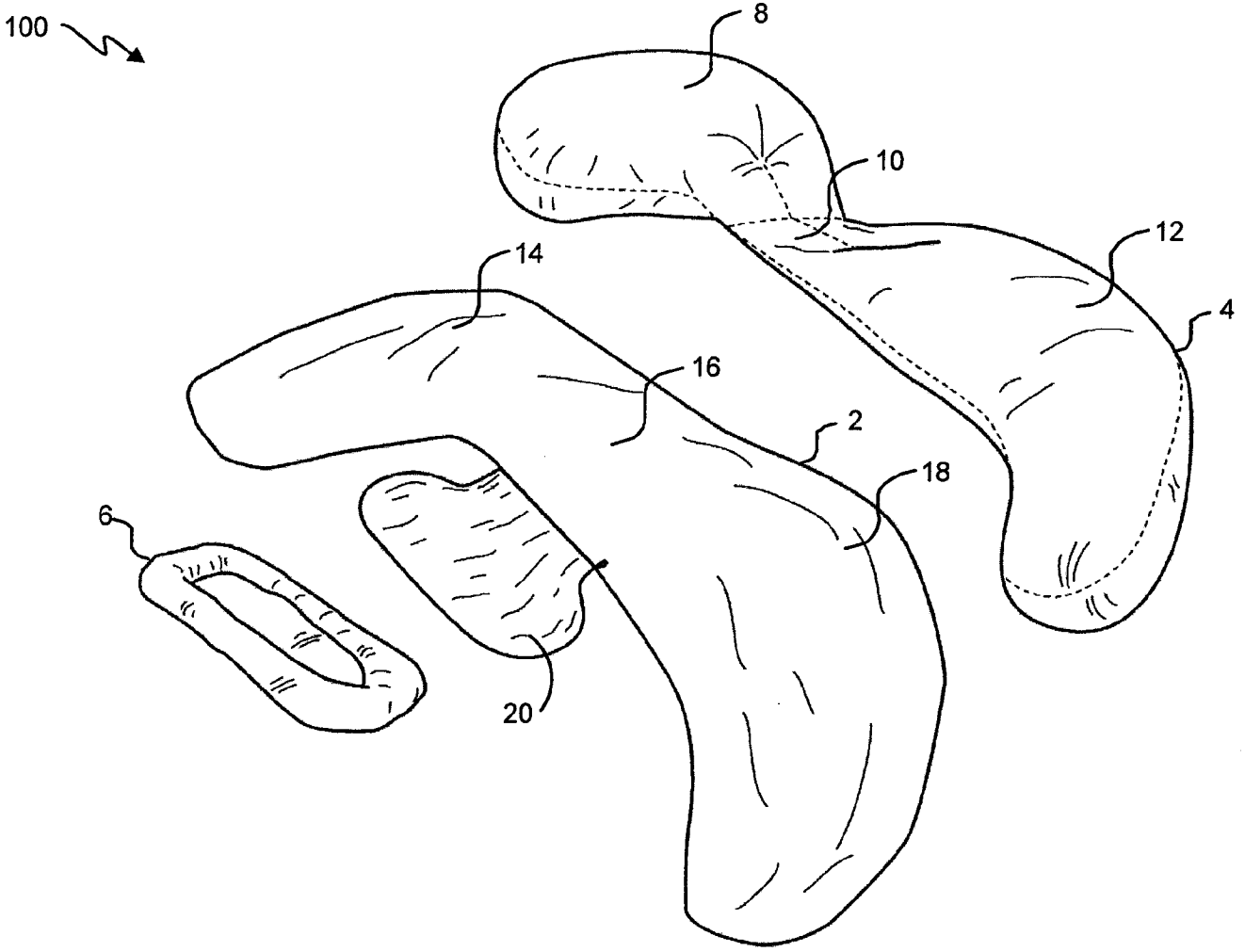
FIG. 1 is a perspective view of an embodiment of a multi-pillow support system.

Referring first to FIG. 1, a perspective view of an embodiment of a multi-pillow support system 100 is shown. The multi-pillow support system 100 comprises a slipcover 2, a body pillow 4, and a torso pillow 6. The body pillow 4 and the torso pillow 6 are configured to be inserted into the slipcover 2. The body pillow 4 has a head portion 8, a central portion 10, and a leg portion 12. Then central portion 10 is disposed between the head portion 8 and the leg portion 12. The slipcover 2 comprises a head section 14, a central section 16, a leg section 18, and a pocket 20. The body pillow 4 is configured to be inserted into the slipcover 2 such that the head portion 8 of the body pillow 4 is inserted into the head section 14 of the slipcover 2, the leg portion 12 of the body pillow 4 is inserted into the leg section 18 of the slipcover 2, and the central portion 10 of the body pillow 4 is inserted into the central section 16 of the slipcover 2. The torso pillow 6 is configured to be inserted into the pocket 20 of the slipcover 2. In some embodiments, the body pillow 4 is similar to a combined head pillow and leg pillow of U.S. application Ser. No. 13/757,508, filed on Feb. 1, 2013, which is incorporated by reference in its entirety for all purposes, except the body pillow 4 in the instant application does not have a removable connection to removably attach the head portion 8 of the body pillow 4 to the central portion 10 of the body pillow 4. In some embodiments, the head pillow and leg pillow of the '508 application are used instead of the body pillow 4. In some embodiments, the body pillow 4 and the torso pillow 6 are removed from the slipcover 2 for washing the slipcover 2. In some embodiments, the head portion 8 has a first height (or thickness), the leg portion 12 has a second height (or thickness), and the central portion 10 has a third height (or thickness); and the third height is less than both the first height and the second height. Put another way, the central portion 10 is thinner than both the head portion 8 and the leg portion 12.

Figure 2:
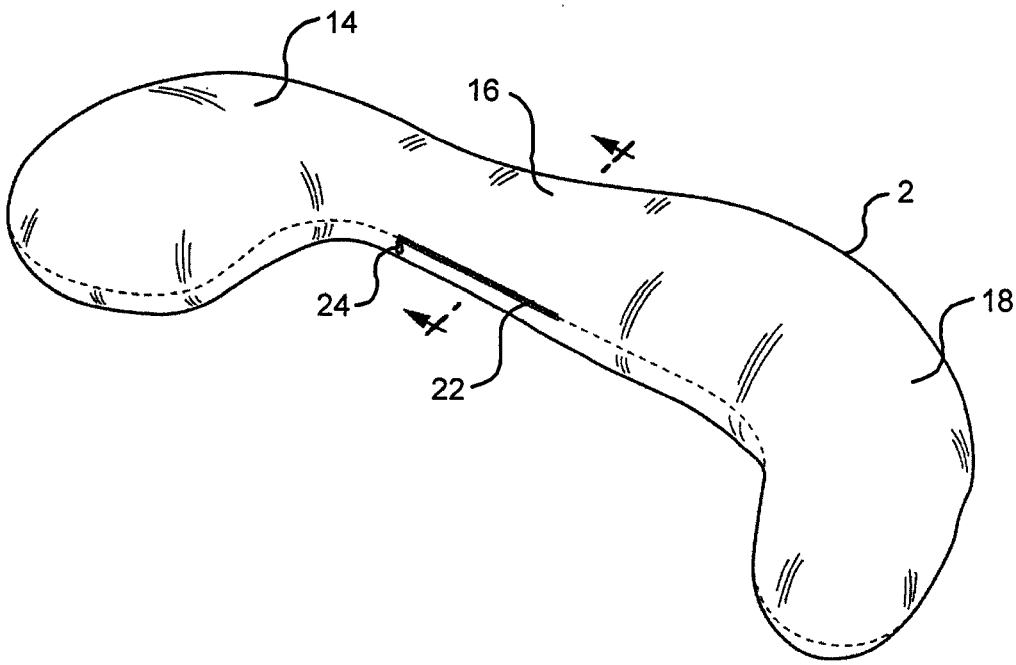
FIG. 2 is a perspective view of the embodiment of the multi-pillow support system in FIG. 1 with both a body pillow and a torso pillow in a slipcover.

FIG. 2 is a perspective view of a configuration of the multi-pillow support system 100 in FIG. 1 with both the body 4 pillow and the torso pillow 6 inside the slipcover 2. In FIG. 2, the head portion 8 of the body pillow 4 is covered by the head section 14 of the slipcover 2, the leg portion 12 of the body pillow 4 is covered by the leg section 18 of the slipcover 2, and the central portion 10 of the body pillow 4 is covered by the central section 16 of the slipcover 2. Further, the torso pillow 6 is on top of the central portion 10 of the body pillow 4, and both the torso pillow 6 and the body pillow 4 are within the central section 16 of the slipcover 2. In FIG. 2, the slipcover 2 has a shape that is similar to a letter "c". On an inside portion (e.g., on an inner periphery of the slipcover 2) of the "c" is a ventral opening 22. In this embodiment, the ventral opening 22 is in the central section 16 of the slipcover 2. The pocket 20 has been inserted through the ventral opening 22 and is inside the central section 16 of the slipcover 2. A first zipper 24 is used to open and close the ventral opening 22. But in some embodiments, the ventral opening 22 is opened and closed by hook-and-loop (e.g., Velcro), buttons, magnets, ties (e.g., laces), pin, broach, etc. In some embodiments, the ventral opening 22 is a fold in fabric of the central section 16 of the slipcover 2. In some embodiments, there is not a way to secure the ventral opening 22 in a closed configuration (e.g., edges of the ventral opening 22 are stitched to prevent fraying, but the first zipper 24 is not added).

Figure 3:
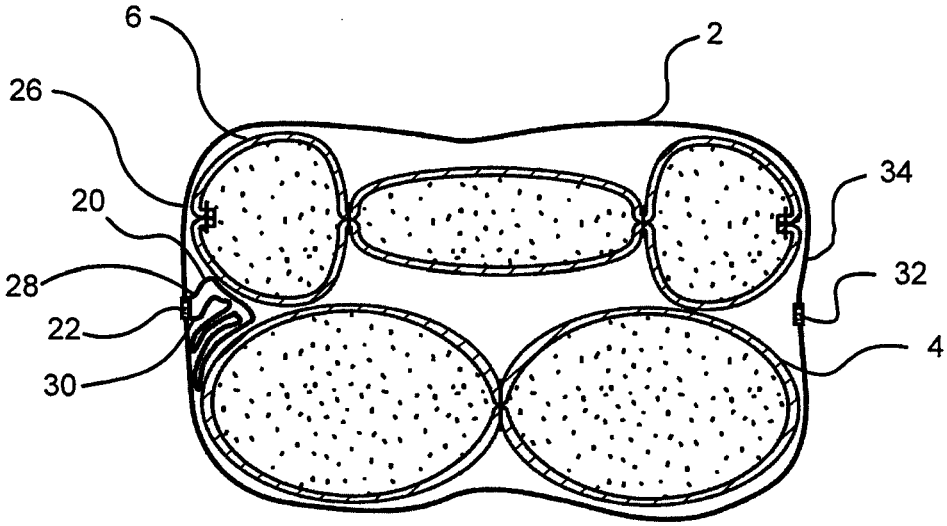
FIG. 3 is a cross-sectional side view of the embodiment of the multi-pillow support system in FIG. 2.

FIG. 3 is a cross-sectional side view of the embodiment of the multi-pillow support system of FIG. 2. A cross-section of the torso pillow 6 is shown on top of a cross-section of the central portion 10 of the body pillow 4. Both the cross-section of the torso pillow 6 and the cross-section of the central portion 10 of the body pillow 4 are surrounded by the central section 16 of the slipcover 2. The ventral opening 22 is shown on a first side 26 (i.e., inside part of the "c") of the slipcover 2. The ventral opening 22 is in a closed configuration (i.e., the first zipper 24 is zipped closed).

The pocket 20 is also shown inserted inside the central section 16 of the slipcover 2. A first edge 28 of the pocket 20 is secured to the slipcover 2, inside the slipcover 2, and above the ventral opening 22. A second edge 30 of the pocket 20 is secured to the slipcover 2, inside the slipcover 2, and below the ventral opening 22.

A dorsal opening 32 is shown on a second side 34 of the slipcover 2 (e.g., on an outer periphery of the slipcover 2). The second side 34 of the slipcover 2 is opposite the first side 26 of the slipcover 2 (i.e., the second side 34 is on an outside of the "c"). In some embodiments, the dorsal opening 32 is used to insert the body pillow 4 and/or the torso pillow 6 inside the slipcover 2.

In some embodiments, the configuration of the multi-pillow support system 100 in FIGS. 2 and 3 is used to store the torso pillow 6. In some embodiments, the configuration of the multi-pillow support system 100 in FIGS. 2 and 3 is used to add support to the central portion 10 of the body pillow 4. For example, a user who is pregnant may use the central portion 10 of the body pillow 4 to support the user's belly (e.g., see FIG. 15 in the '508 application). If the user is not pregnant, and/or chooses not to use the central portion 10 of the body pillow 4 to support the user's belly, the torso pillow 6 can be inserted into the slipcover 2 as described in FIG. 2 to fill more of the central section 16 of the slipcover 2.

Figure 4:
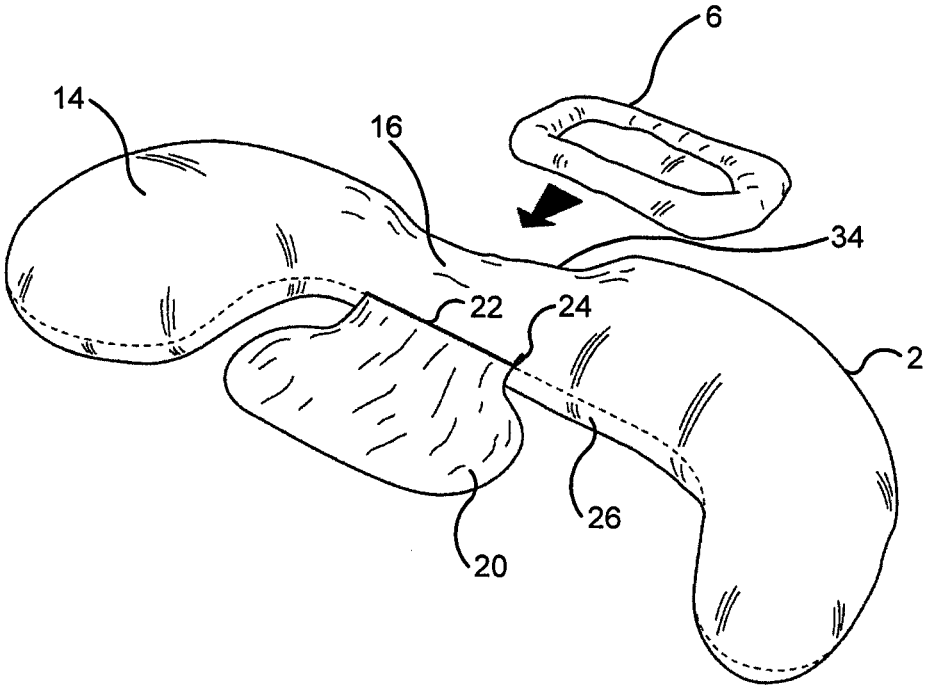
FIG. 4 illustrates a first perspective view of an embodiment of the torso pillow being inserted into a pocket of the slipcover.

FIG. 4 illustrates a first perspective view of an embodiment of the torso pillow 6 being inserted into the pocket 20 of the slipcover 2. In FIG. 4, the body pillow 4 is inside the slipcover 2 as described previously. The ventral opening 22 is in an open configuration (e.g., the first zipper 24 is unzipped). The pocket 20 is removed from being inside the central section 16 of the slipcover 2 and extended away from the central section 16 of the slipcover 2 (e.g., towards a middle of the "c"). The torso pillow 6 is passed through the dorsal opening 32 on the second side 34 of the slipcover 2; through the central section 16 of the slipcover 2; through the ventral opening 22; and into the pocket 20.

Figure 5:
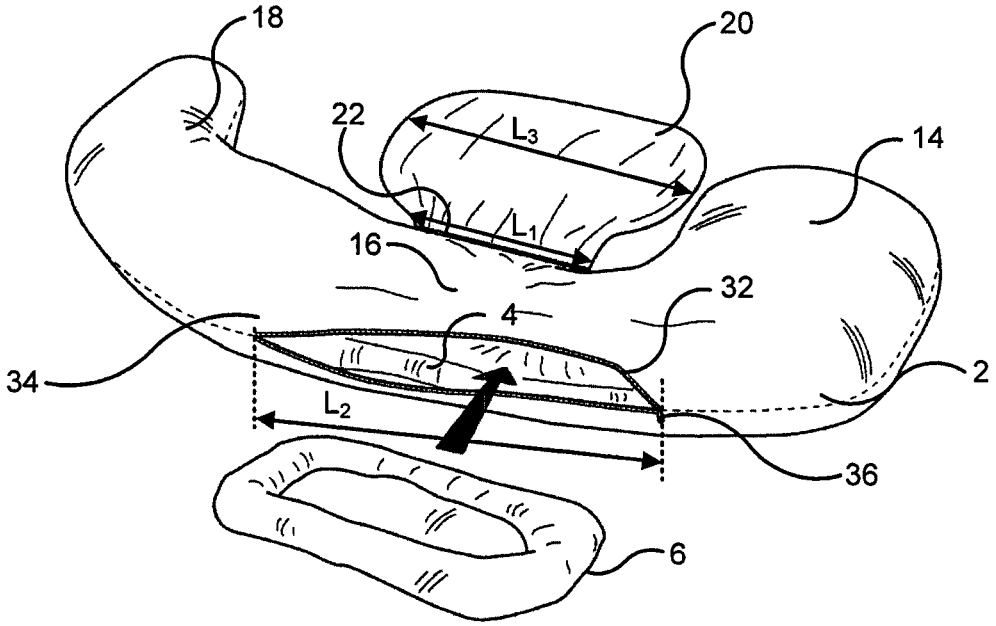
FIG. 5 illustrates a second perspective view of the embodiment of the torso pillow being inserting into the pocket of the slipcover of FIG. 4.

FIG. 5 illustrates a second perspective view of the embodiment of the torso pillow 6 being inserting into the pocket 20 of the slipcover 2 as in FIG. 4. The body pillow 4 is inside the slipcover 2 as described previously. The ventral opening 22 is in an open configuration. The pocket 20 is removed from being inside the central section 16 of the slipcover 2 and extended outside and away from the central section 16 of the slipcover 2 (e.g., towards a middle of the "c"). The pocket 20 is extended from the ventral opening 22. The torso pillow 6 is passed through the dorsal opening 32 on the second side 34 of the slipcover 2; through the central section 16 of the slipcover 2; through the ventral opening 22; and into the pocket 20.

The dorsal opening 32 comprises a second zipper 36. In some embodiments, the dorsal opening 32 does not have a zipper but has an opening similar to those described in some embodiments relating to the ventral opening 22. The second zipper 36 is shown in an open configuration in FIG. 5 (i.e., the second zipper 36 is unzipped). The ventral opening 22 has a first length, L1; and the dorsal opening 32 has a second length L2. In some embodiments, the second length L2 is configured to have a length to enable insertion and removal of the body pillow 4 from the slipcover 2. In some embodiments, the second length L2 of the dorsal opening 32 is from about 25 to 70 inches, and in some cases from about 30 to 35 inches. In some embodiments, the second length L2 is greater than the first length L1. In some embodiments, the first length L1 ranges from about 11 inches to about 21 inches, and in some cases from about 12 inches to about 13 inches. In some embodiments, the pocket 20 has a third length L3 (measured roughly parallel to the ventral opening 22). In some embodiments, the third length L3 is greater than the first length L1. In some embodiments, the first length L1 is minimized to reduce possible interference of a user with the ventral opening 22. In some embodiments, the third length L3 is greater than the first length L1 to more securely hold the torso pillow 6 in the pocket 20 to prevent shifting of the torso pillow. In some embodiments, the third length L3 is greater than 13 inches, and in some cases from about 14 to 27 inches.

In some embodiments, the first zipper 24 comprises a first color and the second zipper 36 comprises a second color. For example, the first color is orange and the second color 36 is white. In some embodiments, the first zipper 24 and the second zipper 36 have different colors for referencing in instructions for using the multi-pillow support system 100. For example, the first zipper 24 is orange and the second zipper 36 is white, and the instructions could state something to the effect: unzip the orange zipper to access the pocket 20, and/or unzip the white zipper to insert and remove the body pillow 4 from the slipcover 2. User confusion can be reduced by using different colors for different zippers. The second color may be chosen for aesthetic purposes and/or the first color chosen as a contrast color. For example, the second color matches a color of the slipcover 2 to blend in with the slipcover 2 because the second color is likely to be observed more often than the first color of the first zipper 24. The first color is chosen as a contrast color of the slipcover 2 to be more easily identified for extending the pocket 20 from outside the central section 16 of the slipcover 2.

Figure 6:
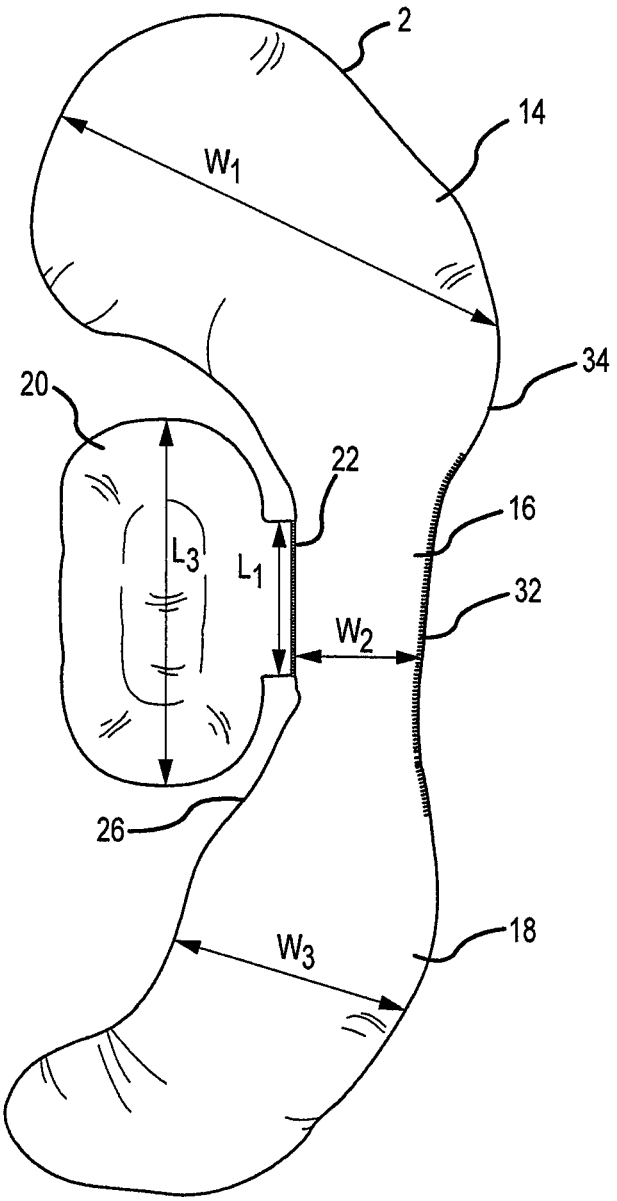
FIG. 6 is a top view an embodiment of the multi-pillow support system comprising a body pillow inside the slipcover and the torso pillow inside a pocket of the slipcover.

FIG. 6 is a top view an embodiment of the multi-pillow support system 100 comprising the body pillow 4 inside the slipcover 2 and the torso pillow 6 inside a pocket 20 of the slipcover 2. FIG. 6 shows the third length L3 of the pocket 20 being greater than the first length L1 of the ventral opening 22. The ventral opening 22 is connected to the central section 16 of the slipcover 2, which is between the head section 14 and the leg section 18 of the slipcover 2. The head section 14 has a first width W1; the central section 16 has a second width W2; and the leg section 18 has a third width W3. Both the first width W1 and the third width W3 are greater than the second width W2. In some embodiments, the first width W1 ranges from about 12 to 30 inches. The second width W2 ranges from about 3 to 18 inches. The third width W3 ranges from about 10 to 24 inches. In some embodiments, widths above are given to be disposed around pillows having similar dimensions as the head pillow and the leg pillow as described in the '508 application.

Figure 7:
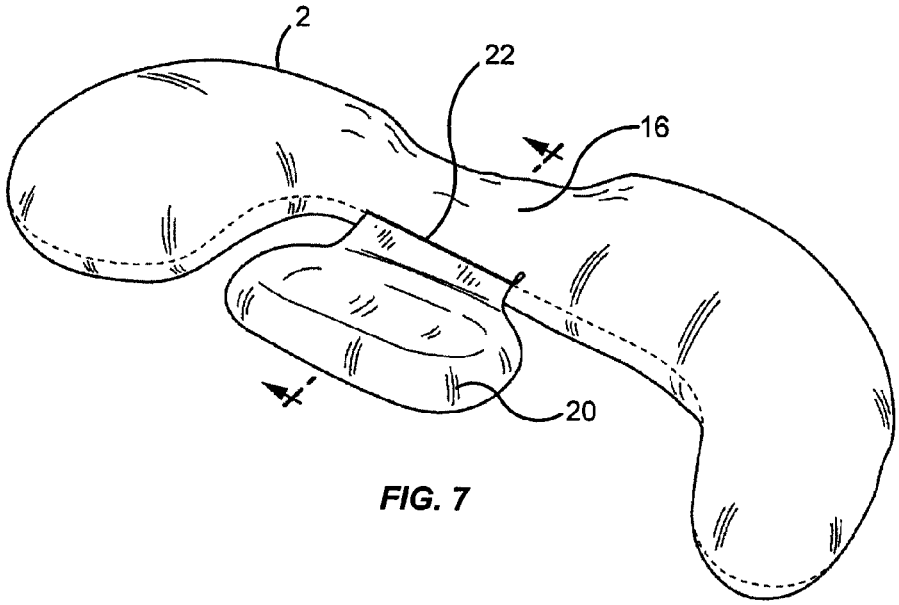
FIG. 7 is a perspective view of the embodiment of the multi-pillow support system of FIG. 6 comprising the body pillow inside a slipcover and the torso pillow inside a pocket of the slipcover.

FIG. 7 is a perspective view of the embodiment of the multi-pillow support system 100 of FIG. 6 comprising the body pillow 4 inside the slipcover 2 and the torso pillow 6 inside the pocket 20 of the slipcover 2. The pocket 20 extends outside the central section 16 of the slipcover 2. The pocket 20 is coupled with the central section 16 through the ventral opening 22.

Figure 8:
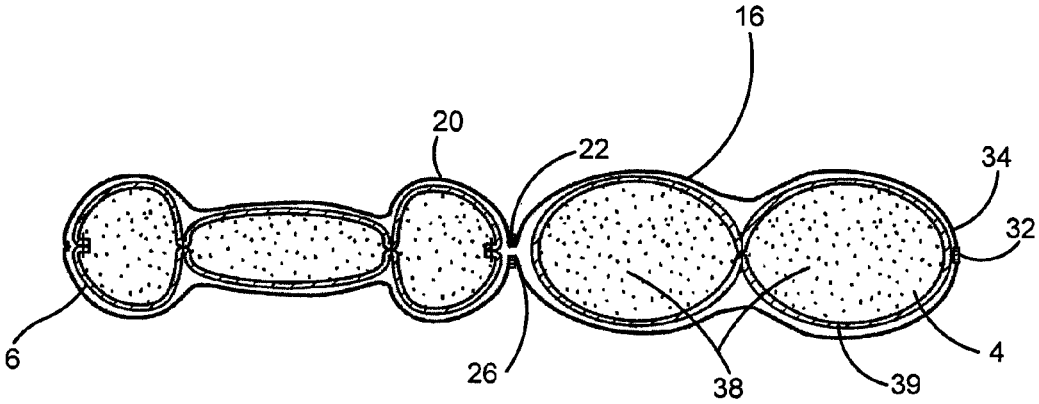
FIG. 8 is a cross-sectional side view of the embodiment of the multi-pillow support system of FIG. 7.

FIG. 8 is a cross-sectional side view the embodiment of the multi-pillow support system 100 of FIG. 7. A cross section of the central portion 10 of the body pillow 4 is in the central section 16 of the slipcover 2. The torso pillow 6 is inside the pocket 20 of the slipcover 2. The pocket 20 is connected with the central section 16 on the first side 26 of the slipcover 2 through the ventral opening 22. The dorsal opening 32, on the second side 34 of the slipcover 2, is in a closed configuration.

The body pillow 4 comprises fill material 38 and a fabric shell 39 surrounding the fill material 38 of the body pillow 4. The fill material 38 is generally a fiber fill (e.g., polyester filling). However, other types of materials may be used, including polybeads, natural materials, feathers, fluids, seeds, beans, and the like. In some cases, the fill material 38 could comprise a fluid, such as air and/or water, that is enclosed within an inflatable bladder. The fabric shell 39 may comprise essentially any type of fabric, such as a cotton fabric, polyester fabric, nylon fabric, or the like. Techniques for constructing pillows may be similar to those described in U.S. Pat. Nos. 7,801,191, 7,089,639, 5,261,134, 5,661,861, 6,038,720, 6,055,687, 6,685,024, 6,434,770, 6,671,908, 6,532,612, 6,279,185, and 6,412,128, the complete disclosures of which are herein incorporated by reference.

Figure 9:
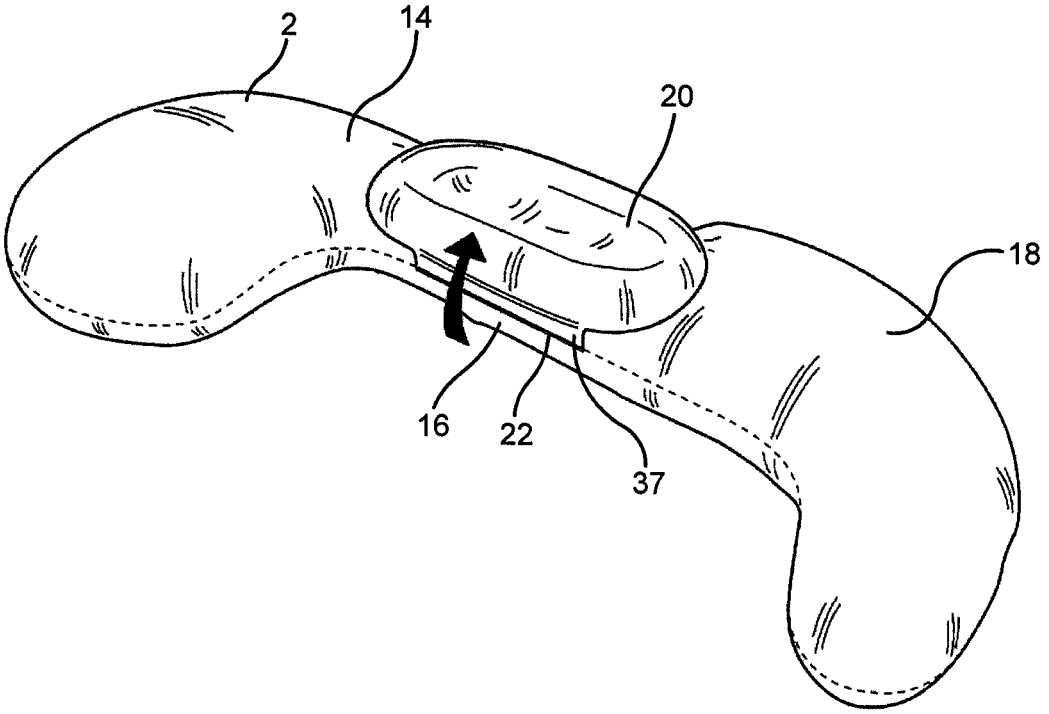
FIG. 9 is a perspective view of an embodiment of the multi-pillow support system having the torso pillow in a pocket of the covering and the torso pillow on top of the body pillow.

FIG. 9 is a perspective view of an embodiment of the multi-pillow support system 100 with the torso pillow 6 in the pocket 20, and the pocket 20 on top of the central section 16 of the slipcover 2. FIG. 9 is similar to FIG. 7, except in FIG. 7 the pocket 20 is positioned next to the central section 16 of the slipcover 2 (i.e., toward the middle/center of the "c"). In FIG. 9, the pocket 20 is positioned on top of the central section 16 of the slipcover 2. In some embodiments, the configuration of the multi-pillow support system 100 in FIG. 9 is used to add support to the central portion 10 of the body pillow 4. For example, a user who is pregnant may use the central portion 10 of the body pillow 4 to support the user's belly. If the user is not pregnant, and/or chooses not to use the central portion 10 of the body pillow 4 to support the user's belly, the torso pillow 6 in the pocket 20 can positioned on top of the central portion 10 of the body pillow 4. In some embodiments, a neck portion 37 of the pocket 20 is used to help position the torso pillow 6 in the pocket 20 on top of the central section 16 of the slipcover 2. For example, with the body pillow 4 in the slipcover 2, the neck portion 37 of the pocket 20 has a length long enough so that the torso pillow 6 in the pocket 20 can sit on top of the central section 16 of the slipcover 2, but the length of the neck portion 37 is short enough so that the torso pillow 6 in the pocket 20 does not fall off the second side 34 of the slipcover 2 (i.e., to the outside of the "c").

Figure 10A:
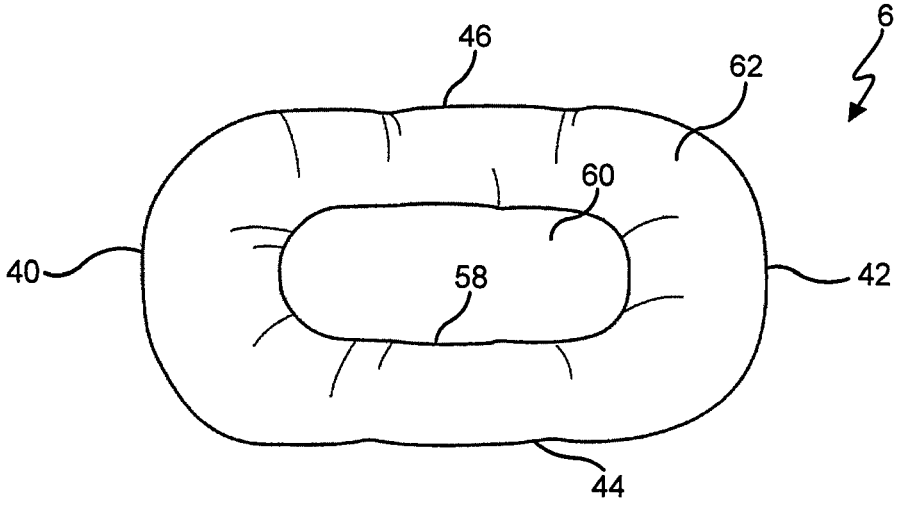
FIGS. 10A-10C are different views of an embodiment of the torso pillow.
Figure 10B:
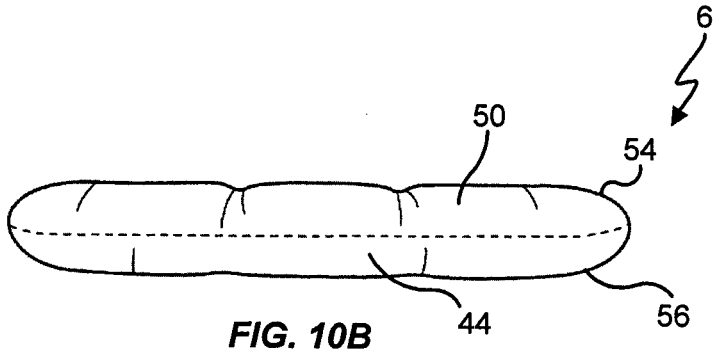
Figure 10C:
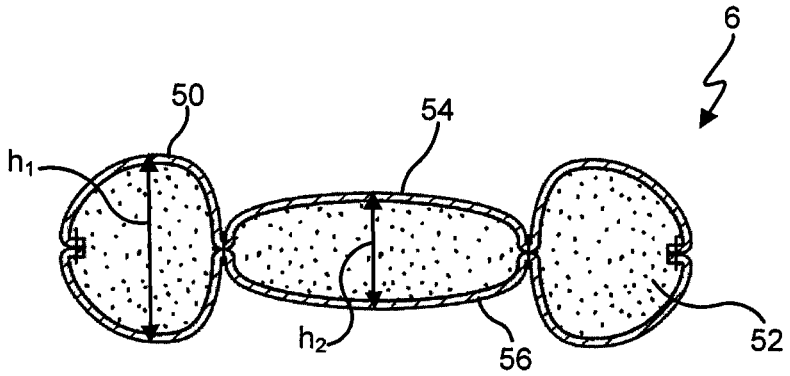

Referring next to FIGS. 10A-10C, different views of an embodiment of the torso pillow 6 are shown. The torso pillow 6 is generally rectangular in geometry (with rounded corners) and may be defined in terms of ends 40 and 42 and sides 44 and 46. However, it will be appreciated that other shapes could be used, such as oval, oblong, circular, square or the like. As best shown in FIG. 10C, the torso pillow 6 may be constructed of a fabric shell 50 that encases a fill material 52. The fabric shell 50 and fill material 52 may be similar to those used in connection with the body pillow 4 and/or any of the other materials described herein. Conveniently, the fabric shell 50 may be constructed of a top piece 54 and a bottom piece 56 that are sewn together using thread. Also, as best shown in 10A, a length of stitching 58 may be completely sewn through the fabric shell 50 and fill material 52 in order to provide the torso pillow 6 with the cross-sectional shape shown in FIG. 10C as well as to keep the fill material 52 from shifting around within fabric shell 50. This length of stitching 58 also allows a center portion 60 of the torso pillow 6 to be stuffed firmer than an outside ring 62. Typically, the length of stitching 58 will be placed a few inches from the outer periphery of torso pillow 6 (e.g., offset from the outer periphery of the torso pillow). Also, it will be appreciated that other stitching patterns could be used.

In some embodiments, the torso pillow 6 has a length between ends 40 and 42 that is in the range from about 14 inches to about 26 inches, and more typically about 20 inches. The torso pillow 6 has a width, from side 44 to side 46, in the range from about 6 inches to about 14 inches, and typically about 10 inches. An outer height h1 (as shown in FIG. 10C) is in the range from about 1 inch to about 5 inches, and more typically about 3 inches. An interior height h2 is in the range from about 0.5 inches to about 4.5 inches, and more typically about 3.5 inches. Such heights are particularly useful when torso pillow 6 is used to support a person's abdomen, and more particularly an abdomen of a woman that may be extended due to a pregnancy. In many cases, it will be desirable to construct center portion 60 so that it is more firm than outside ring 62. This may be accomplished, for example, by stuffing center portion 60 will the fill material so that it is more firm. Also, outer height h1 in some cases may be slightly higher than inner height h2.

Figure 11:
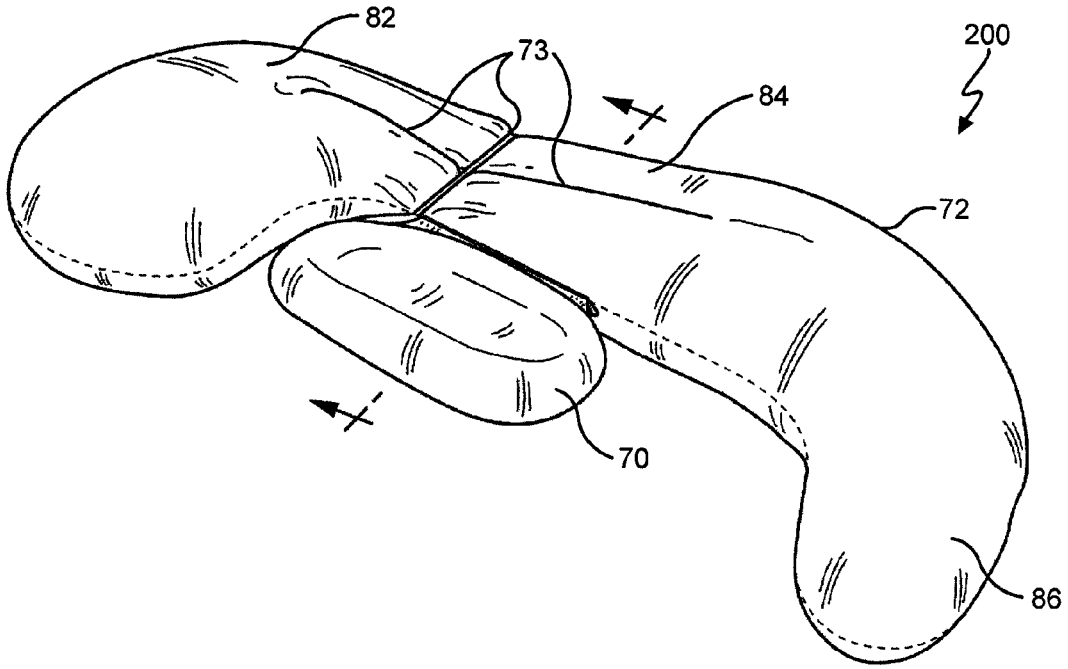
FIG. 11 is a perspective view of another embodiment of the multi-pillow support system having the torso pillow inside a pocket.
Figure 12:
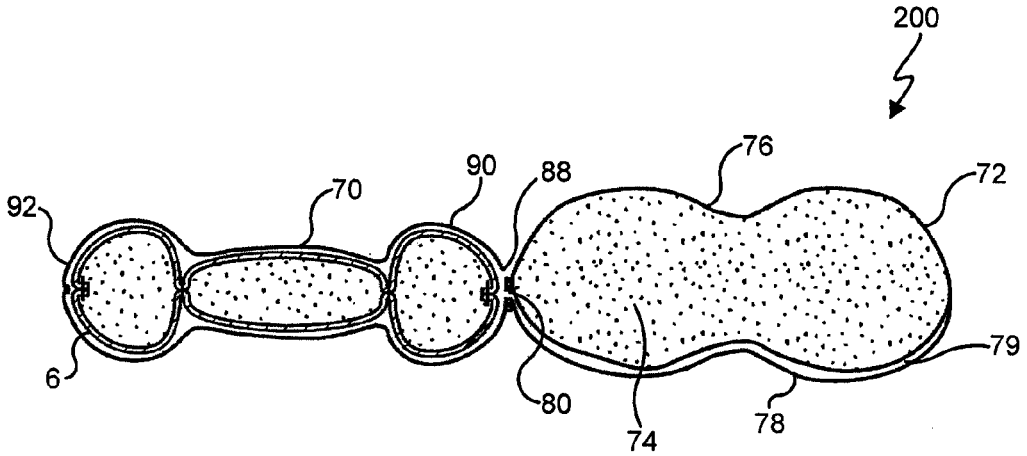
FIG. 12 is a cross-sectional side view of the multi-pillow support system of FIG. 11.

Referring next to FIGS. 11 and 12, FIG. 11 is a perspective view of another embodiment of a multi-pillow support system 200 having a torso pillow 6 inside a pocket 70 of a system pillow 72. The torso pillow 6 is identical to the torso pillow 6 found in FIGS. 10A-10C. FIG. 12 is a cross-sectional side view of the multi-pillow support system 200 of FIG. 11. The multi-pillow support system 200 comprises a system pillow 72 and the torso pillow 6. The multi-pillow support system 200 of FIG. 11 is different from the multi-pillow support system 100 of FIG. 1 in that the multi-pillow support system 200 of FIG. 11 does not have a slipcover 2 separate from the body pillow 4. Instead, the system pillow 72 is upholstered such that the pocket 70 is made as a part of the system pillow 72. In some embodiments, integrating the pocket 70 with the system pillow 72 is beneficial because integration reduces materials and/or manufacturing steps needed to create the multi-pillow support system 200 of FIG. 11. In some embodiments, the system pillow 72 comprises one or more seams 73 (e.g., for spacing fill material and/or shaping the system pillow 72).

The system pillow 72 comprises fill material 74, a fabric shell 76, the pocket 70, a cavity lining 78, and a cavity opening 80. Similar to the body pillow 4, the system pillow 72 has a head portion 82, a central portion 84, and a leg portion 86. The fabric shell 76 surrounds the fill material 74 of the system pillow 72. The fill material 74 of the system pillow 72 is similar to fill material of the body pillow 4. In some embodiments, the fabric shell 76 of the system pillow 72 is similar to material of the fabric shell 39 of the body pillow 4. The cavity lining 78 is additional fabric that is attached to the system pillow 72 for storing the pocket 70 in a cavity 79 of the system pillow 72. The cavity opening 80 can be secured in a closed position in similar ways as the ventral opening 22. The pocket 70 is connected with the central portion 84. The pocket 70 comprises a pocket opening 88 that allows insertion of the torso pillow 6 in the pocket 70 when the pocket 70 is outside the cavity 79. The pocket 70 has a near side 90 and a far side 92 opposite the near side. The near side 90 is closer to the central portion 84 of the system pillow 72 than the far side 92 when the pocket 70 is extended, outside the cavity 79. In some embodiments, the pocket opening 88 is on, or closer to, the near side 90 of the pocket 70.

Figure 13:
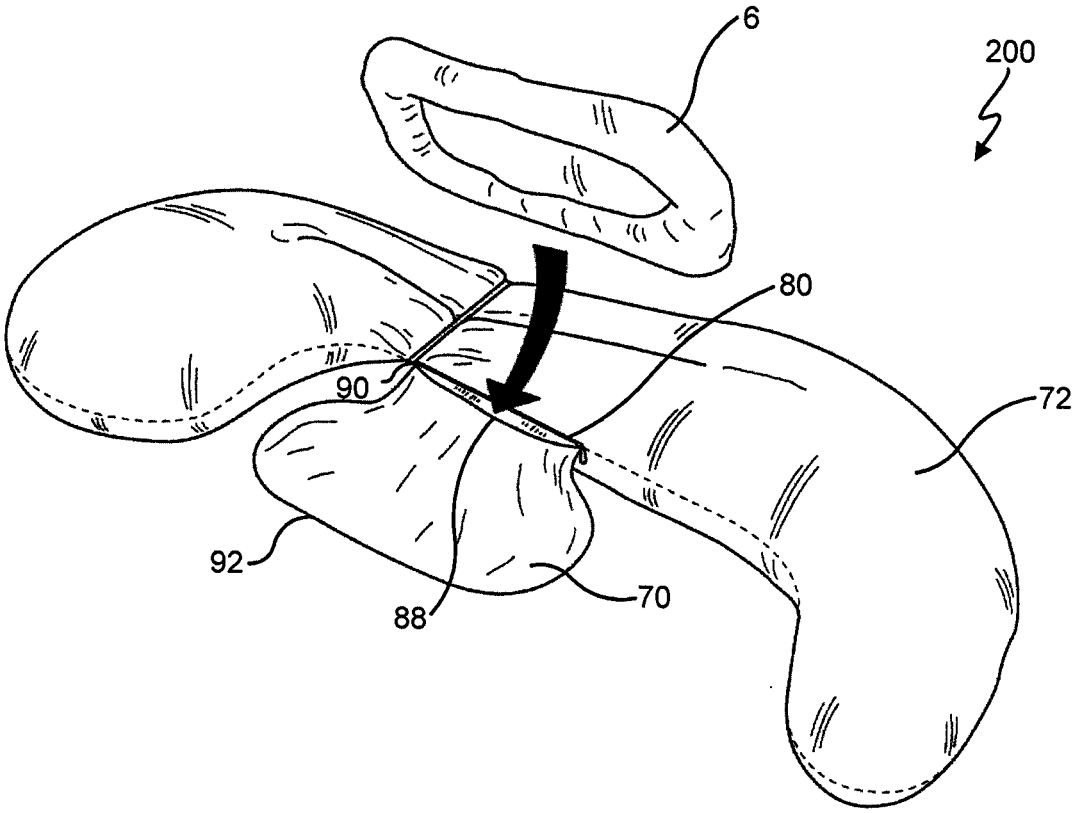
FIG. 13 illustrates a perspective view of a torso pillow being inserted into a pocket of the multi-pillow support system of FIG. 11.

FIG. 13 illustrates a perspective view of a torso pillow 6 being inserted into the pocket 70 of system pillow 72 of FIG. 11. The pocket 70 of the system pillow 72 is extended outside the cavity 79, through the cavity opening 80. The torso pillow 6 is inserted through the pocket opening 88 and into the pocket 70 of the system pillow 72. In some embodiments, the cavity opening 80 has a length that is less than a length of the pocket 70 (and the pocket opening 88 has a length that is less than the length of the pocket 70) as described previously in connection with FIG. 6.

Figure 14:
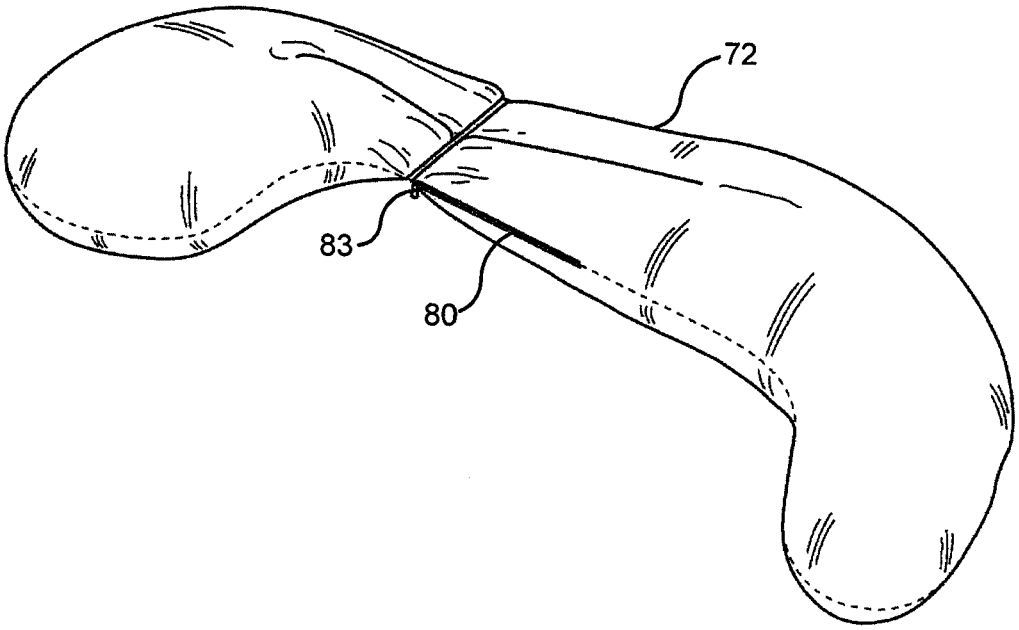
FIG. 14 is a perspective view of an embodiment of the multi-pillow support system of FIG. 11.

FIG. 14 is a perspective view of an embodiment of the multi-pillow support system 200 having the pocket 70 inside the cavity 79 of the system pillow 72. The torso pillow 6 is removed from the pocket 70, and the pocket 70 is inserted, through the cavity opening 80, and the cavity opening 80 is put in a closed configuration (e.g., using a zipper 83). A person of ordinary skill in the art will understand that other types of openings could be used for the cavity opening 80 (e.g., those described previously in connection with the ventral opening 22).

Figure 15:
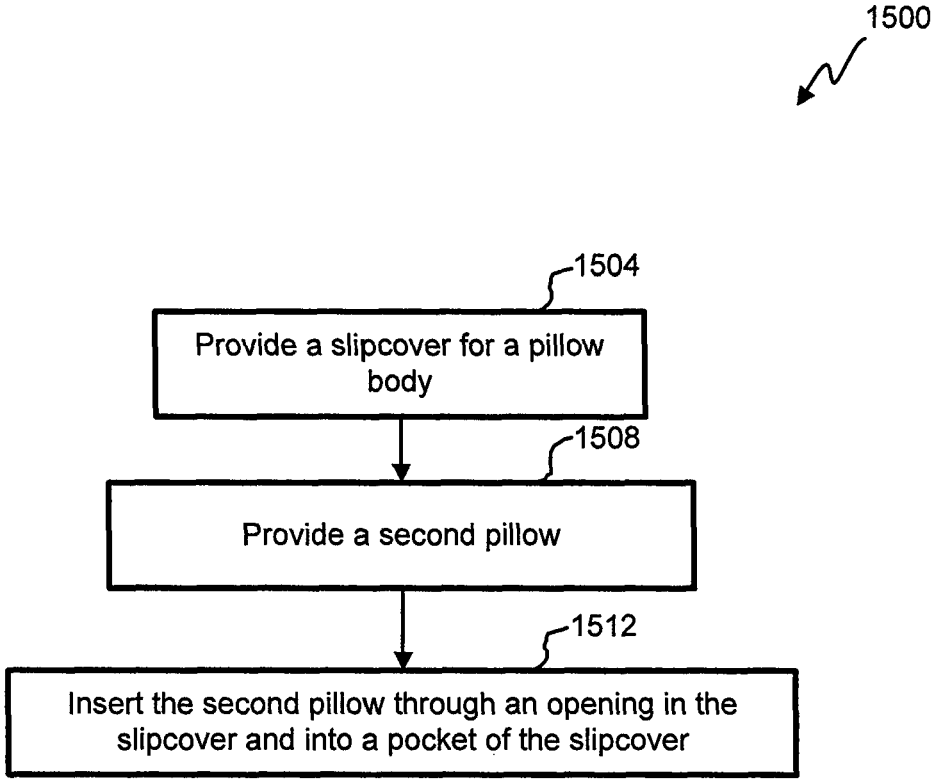
FIG. 15 is a flowchart of an embodiment of a process of using a multi-pillow support system.

FIG. 15 is a flowchart of an embodiment of a process 1500 for inserting a torso pillow 6 into a pocket (e.g., pocket 20 or pocket 70) of a multi-pillow support system. The process 1500 begins in step 1504 where a slipcover for a pillow body is provided. For example, slipcover 2 is provided. In step 1508 a torso pillow is provided. An example of the torso pillow is the torso pillow 6. In step 1512 the torso pillow is inserted through an opening in the covering and into a pocket of the covering. Examples of the opening in the covering include the ventral opening 22 of the slipcover 2, the dorsal opening 32 of the slipcover 2, and the pocket opening 88 of the system pillow 72. In some embodiments, the process 1500 further includes inserting the torso pillow through a second opening of the covering. For example, the torso pillow 6 is inserted through the ventral opening 22 of the slipcover 2 (the opening) and through the dorsal opening 32 of the slipcover 2 (the second opening).

As will be appreciated, a variety of other configurations and arrangements of pillows, pockets, and covers may be used. For example the pocket 70 of the system pillow 72 could be changed to not have pocket opening 88 and be constructed similar to the ventral opening 22. A second cavity opening could be added to the system pillow 72, similar to the dorsal opening 32 of FIG. 5. The torso pillow 6 could then be inserted into the pocket 70 of the system pillow 72 similarly as the torso pillow 6 is inserted into the pocket 20 of the slipcover 2 in FIG. 5. In another example, the pocket 20 of the slipcover 2 could be modified to include a pocket opening 88 and the ventral opening 22 removed (e.g., the pocket 20 of the slipcover 2 being sewn, zipped, button, or tied to the central section 16 of the slipcover 2). In another example, the pocket opening 88 of the system pillow 72 could be on the far side 92 of the pocket 70 of the system pillow 72. The pocket opening 88 could be put in a closed configuration similar to the ventral opening 22 of the slipcover 2 (e.g., with a zipper). In some embodiments, the pocket 20 of the slipcover 2 and/or the pocket 70 of the system pillow 72 are removably attached (e.g., by hook and loop, fabric ties, buttons, zipper, etc.) so that the pocket 20 of the slipcover 2 and/or the pocket 70 of the system pillow 72 can be removed if the torso pillow 6 is not being used.

Figure 16:
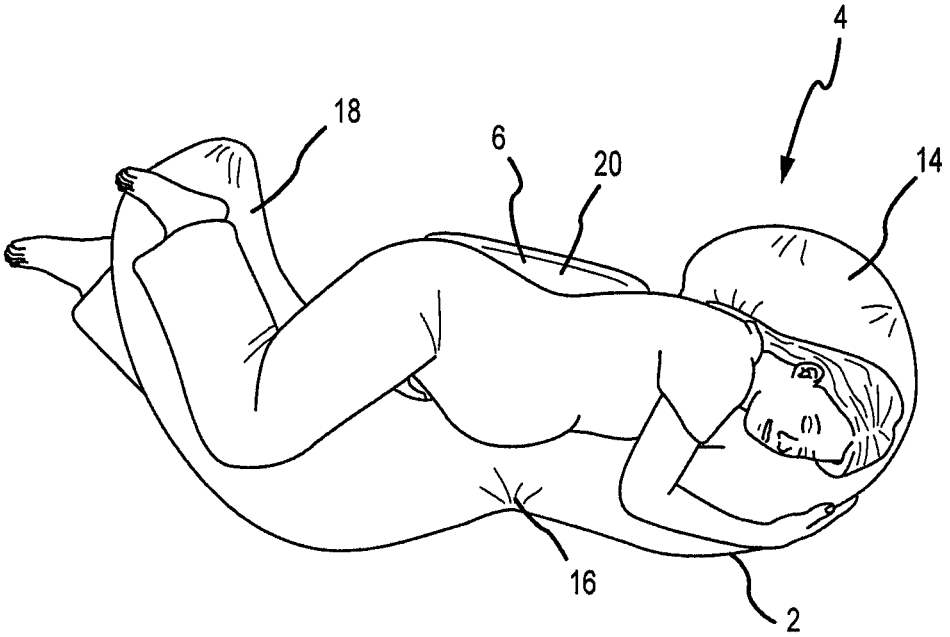
FIG. 16 illustrates the pillow of FIG. 1 when used in one configuration according to the invention.
Figure 17:
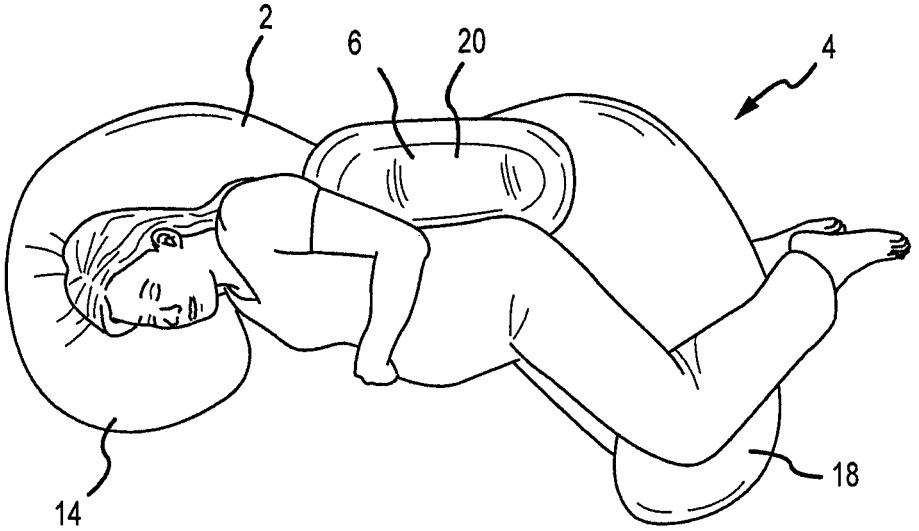
FIG. 17 illustrates the pillow of FIG. 1 when used in another configuration according to the invention.

FIGS. 16 and 17 illustrate exemplary uses of multi-pillow support system 100, it being appreciated that such uses are also conducive with any of the other pillows described herein. As shown in FIG. 16, the user is resting on both body pillow 4 and torso pillow 6. More specifically, the user's head rests on head section 14, the stomach rests on central section 16, and the upper thighs, knees and lower legs rest on leg section 18, with leg section 18 being sandwiched between the user's legs. Torso pillow 6 is extended from central section 16 and supports the user's lower back.

Another use is illustrated in FIG. 17 where torso pillow 6 is folded back onto central section 16 such that the user's lower back is framed and supported by both torso pillow 6 and central section 16. At the same time, the user's head rests on head section 14, with the thighs, knees and lower legs being supported by leg section 18. Although two specific uses are illustrated in FIGS. 16 and 17, it will be appreciated that a variety of other uses are possible.

Figure 18:
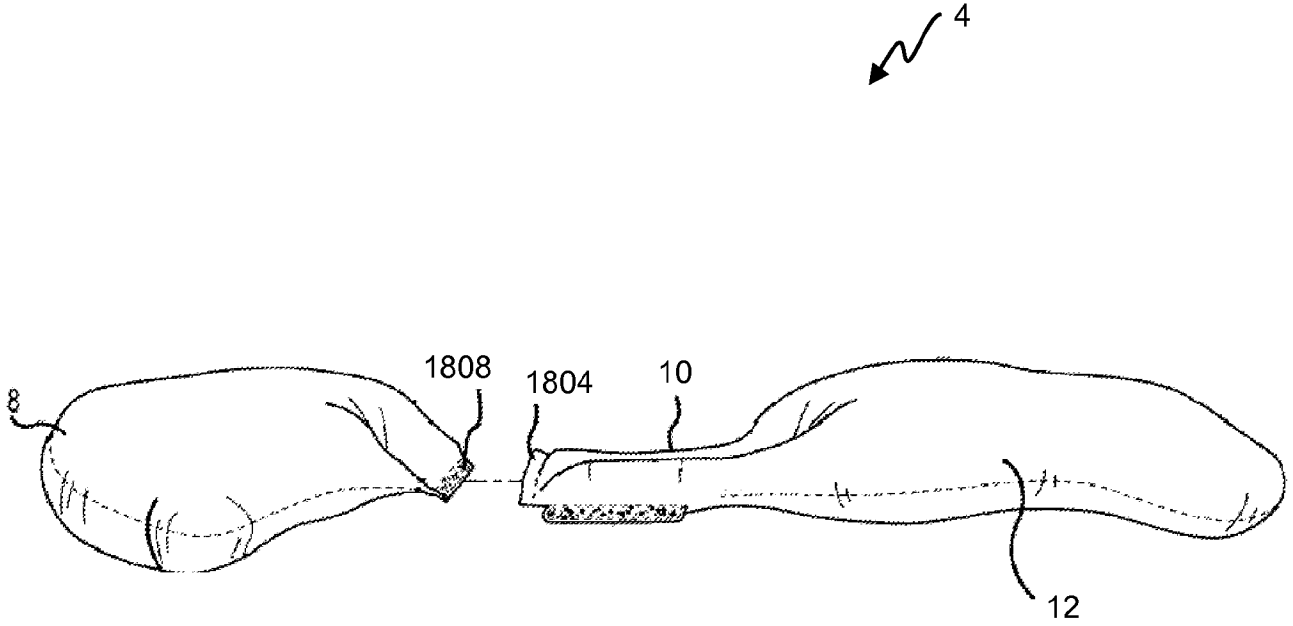
FIG. 18 illustrates a head portion of the body pillow separated from a central portion of the body pillow.

FIG. 18 illustrates a head portion 8 of the body pillow 4 separated from a central portion 10 of the body pillow 4. The central portion 10 may include connector material 1804 at a top end of the central portion 10. The connector material 1804 permits the central portion 10 to be coupled to the head portion 8 using connector material 1808. Connector material 1804 may comprise a hook and loop fastener material to permit it to be coupled to connector material 1808.

The invention has now been described in detail for purposes of clarity and understanding. However, it will be appreciated that certain changes and modifications may be practiced within the scope of the appended claims.

What is claimed is:

1. A pillow system, comprising:

a pillow body comprising fill material and a fabric shell surrounding the fill material, wherein:

the pillow body includes a head portion that is configured to support a user's head; a leg portion that is configured to support a user's leg; and a central portion disposed between the head portion and the leg portion; and the pillow body is elongated and curved, having:

an outer periphery; and an inner periphery that faces the user; and a pocket operably connected with the central portion, the pocket having a stored configuration and an extended configuration, wherein:

in the stored configuration, the pocket is located within a cavity defined by a fabric cavity lining attached to and extending along the pillow body; and in the extended configuration, the pocket extends from the inner periphery away from the body pillow;

a torso pillow is a separate pillow from the pillow body, wherein the torso pillow is located within the pocket in the extended configuration;

the pocket comprises a neck portion;

the neck portion has a first length;

the torso pillow has a second length; and the second length is greater than the first length.

2. The pillow system as in claim 1, wherein:

the fabric shell of the pillow body comprises an opening in the inner periphery; and the pocket is coupled to the opening in the inner periphery of the pillow body.

3. The pillow system as in claim 1, wherein:

the neck portion forms an opening of the pocket for insertion and removal of the torso pillow.

4. The pillow system as in claim 1, wherein the pocket is configured to encapsulate the torso pillow.

5. The pillow system as in claim 1, wherein:

the head portion has a first width;

the leg portion has a second width;

the central portion has a third width; and the first width and the second width are each greater than the third width.

6. The pillow system as in claim 1, wherein:

the head portion has a first height;

the leg portion has a second height;

the central portion has a third height; and the first height and the second height are each greater than the third height.

7. The pillow system as in claim 1, wherein:

the pillow body comprises a head pillow and a leg pillow; and the head pillow is removably attached to the leg pillow.

8. The pillow system as in claim 7, wherein:

the head pillow comprises the head portion; and the leg pillow comprises the leg portion and the central portion.

9. A method of using a pillow system, the method comprising:

providing a pillow body, wherein:

the pillow body comprises fill material and a fabric shell surrounding the fill material;

the pillow body includes a head portion that is configured to support a user's head; a leg portion that is configured to support a user's leg; and a central portion disposed between the head portion and the leg portion; and the pillow body is elongated and curved, having:

an outer periphery; and an inner periphery that faces the user;

removing a pocket from a stored configuration, wherein:

the pocket is operably connected with the central portion; and in the stored configuration, the pocket is located within a cavity defined by a fabric cavity lining attached to and extending along the pillow body;

extending the pocket in an extended configuration, wherein in the extended configuration, the pocket extends from the inner periphery away from the body pillow; and inserting a torso pillow in the pocket while the pocket is in the extended configuration, wherein:

the torso pillow is a separate pillow from the pillow body;

the pocket comprises a neck portion;

the neck portion has a first length;

the torso pillow has a second length; and the second length is greater than the first length.

10. The method of using a pillow system as recited in claim 9, wherein:

the fabric shell of the pillow body comprises an opening in the inner periphery; and the pocket is coupled to the opening in the inner periphery of the pillow body.

11. The method of using a pillow system as recited in claim 9, wherein the torso pillow is inserted in the pocket through an opening in the neck portion of the pocket.

12. The method of using a pillow system as recited in claim 9, the method further comprising a user lying on the pillow system with the user's head on the head portion, the user's leg on the leg portion, and the torso pillow supporting the user's abdomen with the torso pillow in the pocket and the pocket in the extended configuration.

* * * * *